US009607530B2

(12) United States Patent
Valenti, Jr. et al.

(10) Patent No.: US 9,607,530 B2
(45) Date of Patent: Mar. 28, 2017

(54) LABEL FORM INCLUDING CONCEALABLE LABEL

(71) Applicant: Chicago Tag & Label, Inc., Libertyville, IL (US)

(72) Inventors: F. Paul Valenti, Jr., Barrington, IL (US); Carl Opel, Carol Stream, IL (US); Daniel P. Hedger, Grayslake, IL (US)

(73) Assignee: Chicago Tag & Label, Inc., Liberyville, IL (US)

( * ) Notice: Subject to any disclaimer, the term of this patent is extended or adjusted under 35 U.S.C. 154(b) by 0 days.

(21) Appl. No.: 14/787,962

(22) PCT Filed: Oct. 30, 2014

(86) PCT No.: PCT/US2014/063134

§ 371 (c)(1),
(2) Date: Oct. 29, 2015

(87) PCT Pub. No.: WO2015/069539

PCT Pub. Date: May 14, 2015

(65) Prior Publication Data

US 2016/0078788 A1 Mar. 17, 2016

Related U.S. Application Data

(63) Continuation of application No. 14/071,794, filed on Nov. 5, 2013, now abandoned.

(51) Int. Cl.

| | |
|---|---|
| ***G09F 3/00*** | (2006.01) |
| ***B65D 25/20*** | (2006.01) |
| *G09F 3/02* | (2006.01) |

(52) U.S. Cl.
CPC ..... *G09F 3/0289* (2013.01); *B65D 25/205* (2013.01); *G09F 2003/022* (2013.01);
(Continued)

(58) Field of Classification Search
CPC . G09F 3/02; G09F 3/10; G09F 3/0288; G09F 2003/0267; G09F 2003/0201; G09F 2003/0269; G09F 2003/0226; G09F 2003/0222; G09F 3/0289; G09F 2003/0213; G09F 2003/0216; G09F 2003/0272; G09F 2003/023; G09F 2003/022; B26F 1/44; B26F 1/20; B26F 1/22; B26D 3/08;
(Continued)

(56) References Cited

U.S. PATENT DOCUMENTS 4,614,361 A 9/1986 Foster
4,708,368 A 11/1987 Instance
(Continued)

OTHER PUBLICATIONS

Application No. PCT/US2014/063134, International Searching Authority, International Search Report, Feb. 19, 2015.

*Primary Examiner* — Patricia L Nordmeyer
(74) *Attorney, Agent, or Firm* — Ice Miller LLP

(57) ABSTRACT

A label form that includes a sheet material and a substrate piece is disclosed. The sheet material has a covering section and a concealable section connected to the covering section. The reinforcing piece is attached to a surface of the sheet material. When the concealable section is folded under the covering section, at least a portion of the undersurface of the reinforcing piece is revealed.

20 Claims, 20 Drawing Sheets

(52) U.S. Cl.
CPC ..... *G09F 2003/023* (2013.01); *G09F 2003/0213* (2013.01); *G09F 2003/0216* (2013.01); *G09F 2003/0222* (2013.01); *G09F 2003/0269* (2013.01); *G09F 2003/0272* (2013.01); *Y10T 428/15* (2015.01)

(58) Field of Classification Search
CPC ..... B26D 25/205; Y10T 428/1476; Y10T 428/14; Y10T 428/1486; Y10T 428/149; Y10T 428/1495; Y10T 428/15; Y10T 428/24273; Y10T 428/1471; Y10T 428/23; Y10T 428/2419; B42D 15/006
See application file for complete search history.

(56) References Cited

U.S. PATENT DOCUMENTS 4,983,438 A 1/1991 Jameson
5,071,167 A 12/1991 O'Brien
5,228,945 A 7/1993 Labbé
5,308,119 A * 5/1994 Roshkoff ..... B42D 15/004 283/105
5,509,694 A 4/1996 Laurash et al.
5,776,571 A 7/1998 Michlin et al.
5,800,893 A 9/1998 Harden
5,824,380 A 10/1998 Hagen
5,975,582 A * 11/1999 Treleaven ..... G09F 3/0289 283/81
6,378,588 B1 4/2002 Nixon et al.
6,394,500 B1 5/2002 Nixon et al.
6,511,569 B1 1/2003 Nixon et al.
6,596,359 B2 7/2003 Roth et al.
6,644,538 B1 11/2003 Schnitzer
6,676,794 B1 1/2004 Petkovsek
7,045,034 B2 5/2006 McKillip
7,473,452 B2 1/2009 McKillip
7,475,912 B1 1/2009 Reffett
7,762,302 B2 7/2010 Dangami
7,923,089 B1 4/2011 Valenti, Jr. et al.
8,147,641 B1 4/2012 Valenti, Jr. et al.
8,449,963 B1 5/2013 Valenti, Jr. et al.
2002/0113428 A1 8/2002 Phillips et al.
2006/0244662 A1 11/2006 Bauer et al.
2013/0093178 A1 4/2013 Shanley et al.
2013/0249205 A1 9/2013 Bellmyer et al.

* cited by examiner

LABEL FORM INCLUDING CONCEALABLE LABEL

RELATED APPLICATION

The present application is related to, claims the priority benefit of, and is a U.S. §371 national stage entry of, International Patent Application Serial No. PCT/US2014/063134, filed Oct. 30, 2014; which is related to, claims the priority benefit of U.S. patent application Ser. No. 14/071,794, filed Nov. 5, 2013. The contents of each of the foregoing patent applications are hereby incorporated by reference in their entirety into this disclosure.

BACKGROUND

Labels are commonly used to secure printed indicia to packages to indicate shipping or other information. In the instance of a shipping use, a separate packing list may be enclosed within a package shipped to the customer containing a purchased item.

There is significant demand for a labeling method that allows automatic printing and application of a lower label and an upper label to a surface. For example, there is significant demand for a labeling method that allows automatic printing and application of a packing list and shipping label to the surface of a sealed carton. Because the carton is sealed prior to packing list generation, it is not efficient to open it to insert a packing list. High volume shipping of such packages requires rapid attachment of a packing list and a shipping label to the package. It is preferred to conceal the information of the packing list until the final recipient receives the shipped package.

For the foregoing reasons, it is desired to provide labeling forms and methods that allows automatic printing and application of a packing list label and shipping label to the surface of a sealed carton while avoiding the many shortcomings of existing labeling forms and methods.

SUMMARY

The present disclosure includes disclosure of label forms including concealable labels. In at least one embodiment, a label form according to the present disclosure comprises a sheet material, the sheet material comprising a first surface and a second surface opposite the first surface, the sheet material comprising a covering section and a concealable section connected to the covering section, the covering section comprising a bottom margin, the concealable section comprising a top edge; a reinforcing piece, the reinforcing piece comprising a top surface and an undersurface opposite the top surface, the reinforcing piece comprising at least one reinforcing piece boundary, the undersurface of the reinforcing piece adhered to the first surface of the sheet material; and a first line of weakness through the sheet material, the first line of weakness defining the top edge of the concealable section, the first line of weakness located beneath the reinforcing piece.

In an aspect of a label form according to at least one embodiment of the present disclosure, the top edge of the concealable section is inboard of the bottom margin of the covering section.

In an aspect of a label form according to at least one embodiment of the present disclosure, the concealable section is foldable at the first line of weakness to an orientation where the bottom surface of the concealable section is in contact with the bottom surface of the covering section.

In an aspect of a label form according to at least one embodiment of the present disclosure, at least a portion of the bottom surface of the covering section comprises adhesive.

In an aspect of a label form according to at least one embodiment of the present disclosure, the label for further comprises a release patch on the first surface, the release patch being underneath at least a portion of the reinforcing piece, the portion of the reinforcing piece removably adhered to the release patch. In an aspect of a label form according to at least one embodiment of the present disclosure, a first part of the release patch is on the covering section. In an aspect of a label form according to at least one embodiment of the present disclosure, a second part of the release patch is on the concealable section.

In an aspect of a label form according to at least one embodiment of the present disclosure, the concealable section is foldable at the first line of weakness, and when the concealable section is folded at the first line of weakness the second part of the release patch separates from the reinforcing piece.

In an aspect of a label form according to at least one embodiment of the present disclosure, the concealable section is foldable at the first line of weakness, and when the concealable section is folded at the first line of weakness a portion of the undersurface of the reinforcing piece is revealed.

In an aspect of a label form according to at least one embodiment of the present disclosure, the label form further comprises a second line of weakness through the reinforcing piece, the second line of weakness in registration with the first line of weakness. In an aspect of a label form according to at least one embodiment of the present disclosure, the second line of weakness is at least as long as the first line of weakness. In an aspect of a label form according to at least one embodiment of the present disclosure, the label form further comprises at least one other line of weakness through the sheet material and the reinforcing piece, the at least one other line of weakness connected to endpoints of the first line of weakness, the first line of weakness and the at least one other line of weakness defining boundaries of a removable area of the covering section. In an aspect of a label form according to at least one embodiment of the present disclosure, the second line of weakness, the at least one other line of weakness, and the at least one reinforcing piece boundary define a removable sector of the reinforcing piece, the removable sector of the reinforcing piece being adhered to the removable area of the sheet material. In an aspect of a label form according to at least one embodiment of the present disclosure, the concealable section is foldable at the first line of weakness to an orientation where the bottom surface of the concealable section is in contact with the bottom surface of the covering section, and when the concealable section is folded into such an orientation the concealable section fits within the boundaries of the removable area of the covering section.

In at least one embodiment, a label form according to the present disclosure comprises a sheet material, the sheet material comprising a first surface and a second surface opposite the first surface, the sheet material comprising a covering section and a concealable section connected to the covering section and folded under the covering section such that the concealed section is in contact with the second surface of the covering section, the second surface of the covering section comprising adhesive on an area partially surrounding the concealed section; and a reinforcing piece, the reinforcing piece comprising a top surface and an undersurface opposite the top surface, the undersurface of the reinforcing piece comprising adhesive on at least a portion thereof, the undersurface comprising a first part and a second part, the first part being adhered to the first surface of the sheet material and the second part comprising exposed adhesive. In an aspect of a label form according to at least one embodiment of the present disclosure, the label form further comprises at least one line of weakness through the sheet material and the reinforcing piece, the at least one line of weakness defining boundaries of a removable area of the covering section. In an aspect of a label form according to at least one embodiment of the present disclosure, the removable area of the covering section is in alignment with the folded-under concealed section.

In at least one embodiment, the present disclosure comprises a container, the container comprising a face; a label, the label comprising a sheet material, the sheet material comprising a first surface and a second surface opposite the first surface, the sheet material comprising a covering section and a concealable section connected to the covering section and folded under the covering section, at least a portion of the second surface being adhered to the face; and a reinforcing piece, the reinforcing piece comprising a top surface and an undersurface opposite the top surface, the undersurface of the reinforcing piece comprising adhesive on at least a portion thereof, the undersurface comprising a first part and a second part, the first part being adhered to the first surface of the sheet material and the second part being adhered to the face. In an aspect of at least one embodiment of the present disclosure, such a label further comprises at least one line of weakness through the sheet material and the reinforcing piece, the at least one line of weakness defining boundaries of a removable area of the covering section. In an aspect of at least one embodiment of the present disclosure, the removable area of the covering section is in alignment with the folded-under concealed section.

BRIEF DESCRIPTION OF THE DRAWINGS

The features and advantages of this disclosure, and the manner of attaining them, will be more apparent and better understood by reference to the following descriptions of the disclosed methods and systems, taken in conjunction with the accompanying drawings, wherein.

DESCRIPTION

Figure 1A:
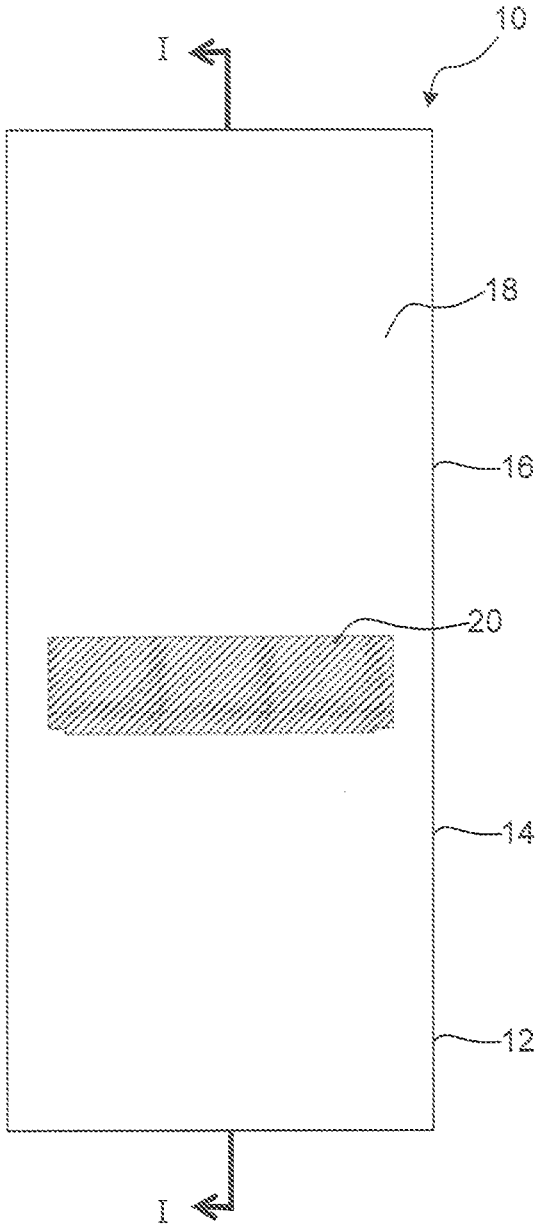
FIG. 1A shows a top view of a partially assembled label form according to at least one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Figure 1B:
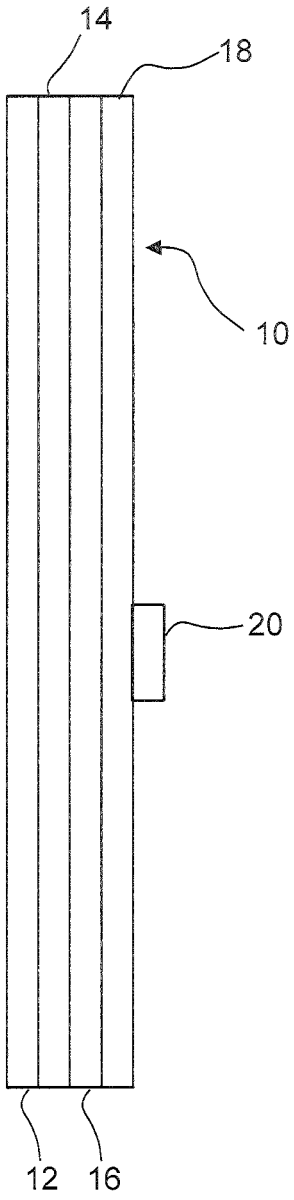
FIG. 1B shows a cross-sectional view of a partially assembled label form according to at least one embodiment of the present disclosure.

FIG. 1A shows a top view of a partially assembled label form 10 according to at least one embodiment of the present disclosure. FIG. 1B shows a cross-sectional view of partially assembled label form 10 of FIG. 1A, taken along line I-I in FIG. 1A. Shown in FIGS. 1A-B is label 18. Label 18 comprises a material such as paper that is receptive to indicia printed thereon.

Label 18 is removably adhered to liner 12. Liner 12 comprises a release layer 14, which in at least one embodiment substantially covers liner 12 on the surface thereof facing the underside of label 18. Label 18 comprises adhesive 16 on a surface thereof facing liner 12. Neither release layer 14 nor adhesive 16 are visible in FIG. 1A. In at least one embodiment, adhesive 16 comprises a pressure sensitive adhesive. Also shown in FIGS. 1A-B is release patch 20, which is printed on a surface of label 18. Release layer 14 and release patch 20 may comprise a material such as, for example, a silicone material, that allows for the removable adherence of adhesive materials thereto. Any type of coating material (including no-silicone coatings) that permits the removable adherence adhesive materials thereto may be used.

Figure 2:
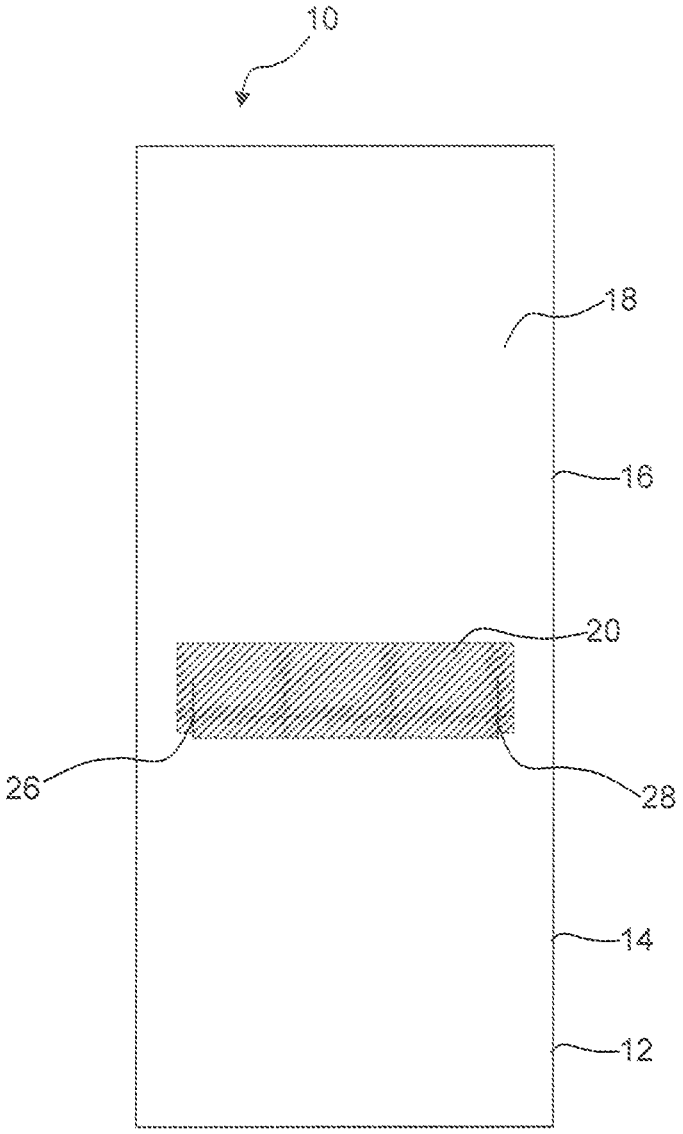
FIG. 2 shows a top view of a partially assembled label form according to at least one embodiment of the present disclosure.

FIG. 2 shows a top view of a partially assembled label form 10 according to at least one embodiment of the present disclosure. As shown in FIG. 2, slits 26 and 28 are cut through release patch 20 and label 18, but not into liner 12, such as, for example, by die cutting.

Figure 3A:
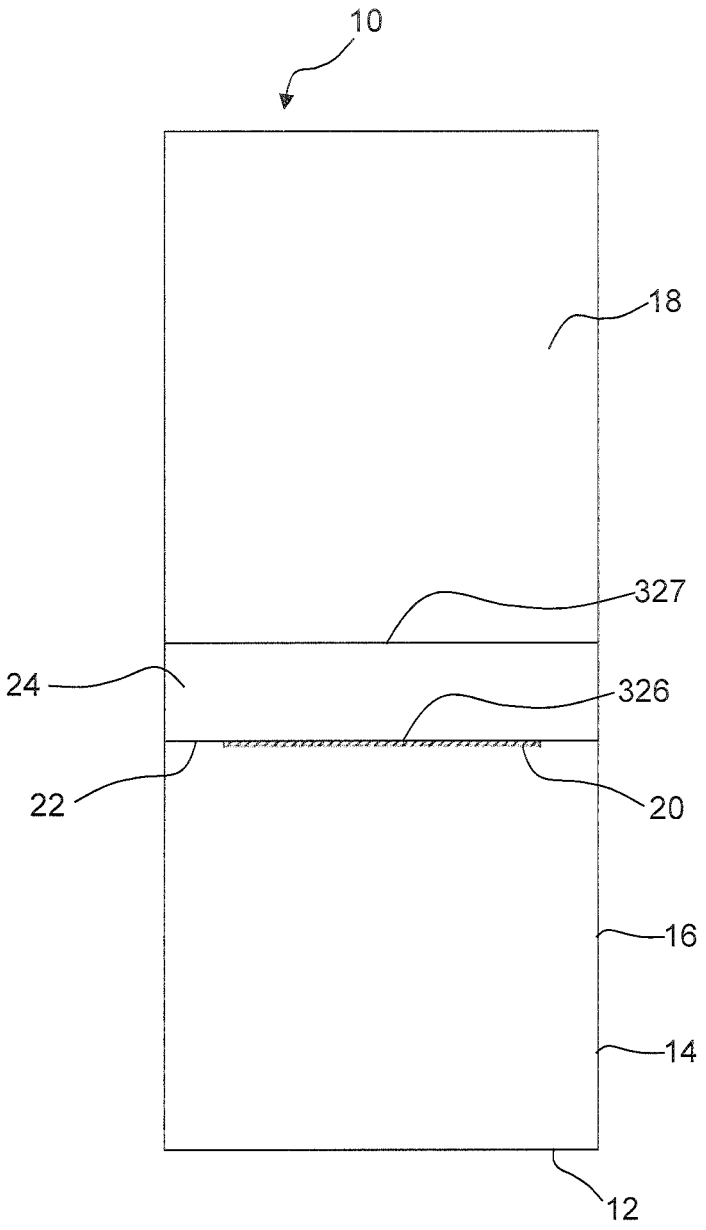
FIG. 3A shows a top view of a partially assembled label form according to at least one embodiment of the present disclosure.
Figure 3B:
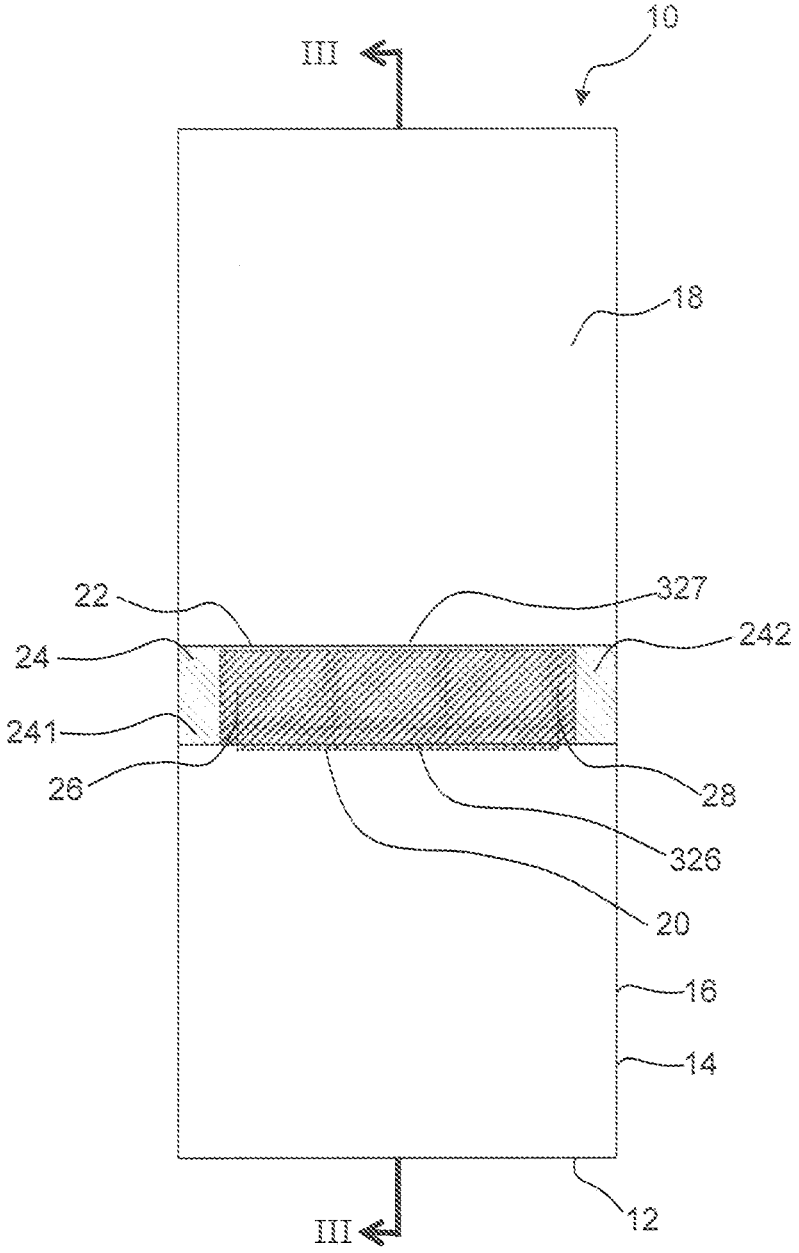
FIG. 3B shows a top view of a partially assembled label form according to at least one embodiment of the present disclosure.
Figure 3C:
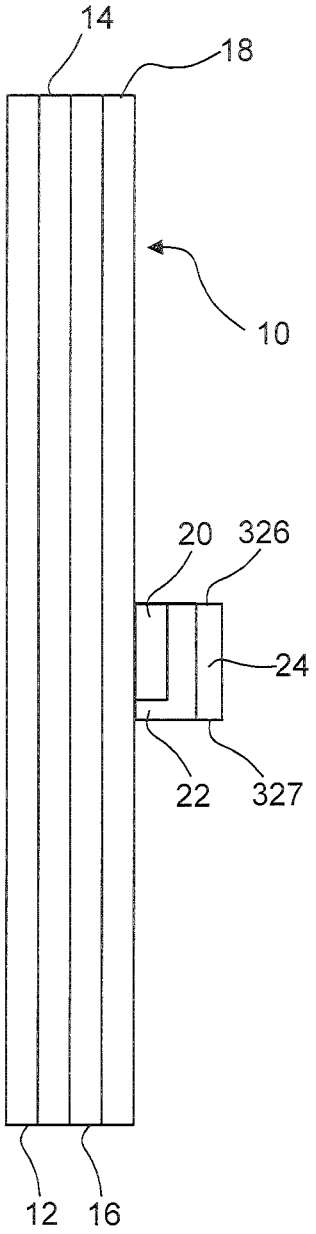
FIG. 3C shows a cross-sectional view of a partially assembled label form according to at least one embodiment of the present disclosure.

FIG. 3A shows a top view of a partially assembled label form 10 according to at least one embodiment of the present disclosure. As shown in FIG. 3A, substrate material 24 has been installed over release patch 20. Substrate material comprises paper, polyester, or another suitable sheet material. FIG. 3B shows a top view of the partially assembled label form 10 according to FIG. 3A, with substrate material 24 shown transparently to illustrate the alignment of substrate material 24 with release patch 20 and slits 26 and 28. FIG. 3C shows a cross-sectional view of partially assembled label form 10 of FIGS. 3A-3B, taken along line III-III in FIG. 3B.

As shown in FIGS. 3A-C, substrate material 24 comprises lateral edges 326, 327, and adhesive 22 on a surface thereof facing release patch 20. In at least one embodiment, adhesive 22 comprises a permanent pressure sensitive adhesive, although removable pressure sensitive adhesive could be used. Such an adhesive can be an acrylic adhesive or a hot melt adhesive. As shown in FIGS. 3A-B, the surface area of substrate material 24 is larger than that of release patch 20, so substrate material 24 extends beyond the boundaries of release patch 20. Accordingly, where substrate material 24 extends beyond the boundaries of release patch 20 such as, for example, in areas 241 and 242, adhesive 22 adheres substrate material 24 directly to label 18. The interaction between adhesive 22, label 18, and substrate material 24 in those areas outside the boundaries of release patch 20 (such as, for example, in areas 241 and 242) substantially permanently adheres substrate material 24 to a surface of label 18 in those areas. However, the interaction between release patch 20 and adhesive material 22 provides for removable adherence of substrate material 24 to release patch 20 in the areas where substrate material 24 covers release patch 20.

Figure 4A:
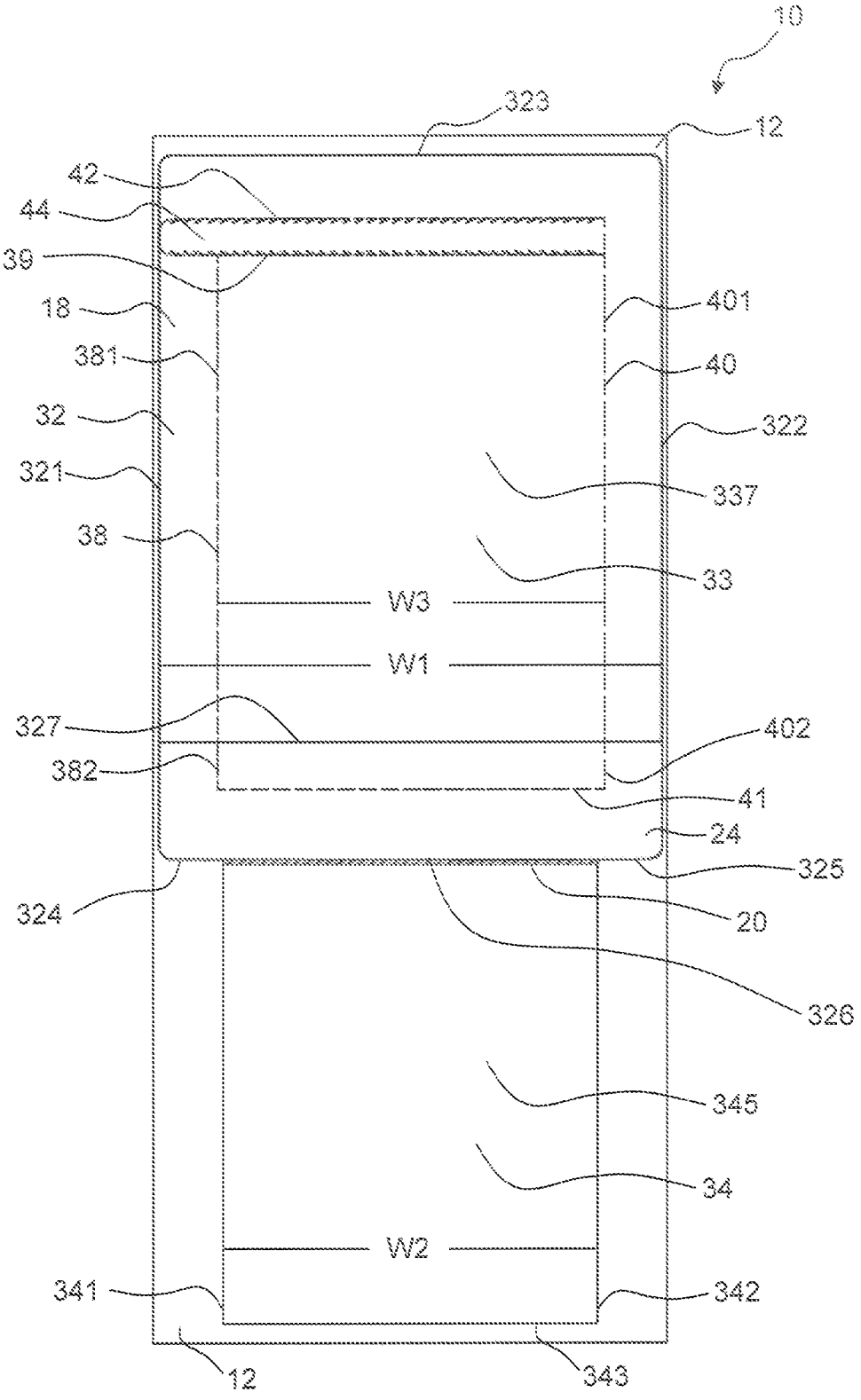
FIG. 4A shows a top view of a label form according to at least one embodiment of the present disclosure.
Figure 4B:
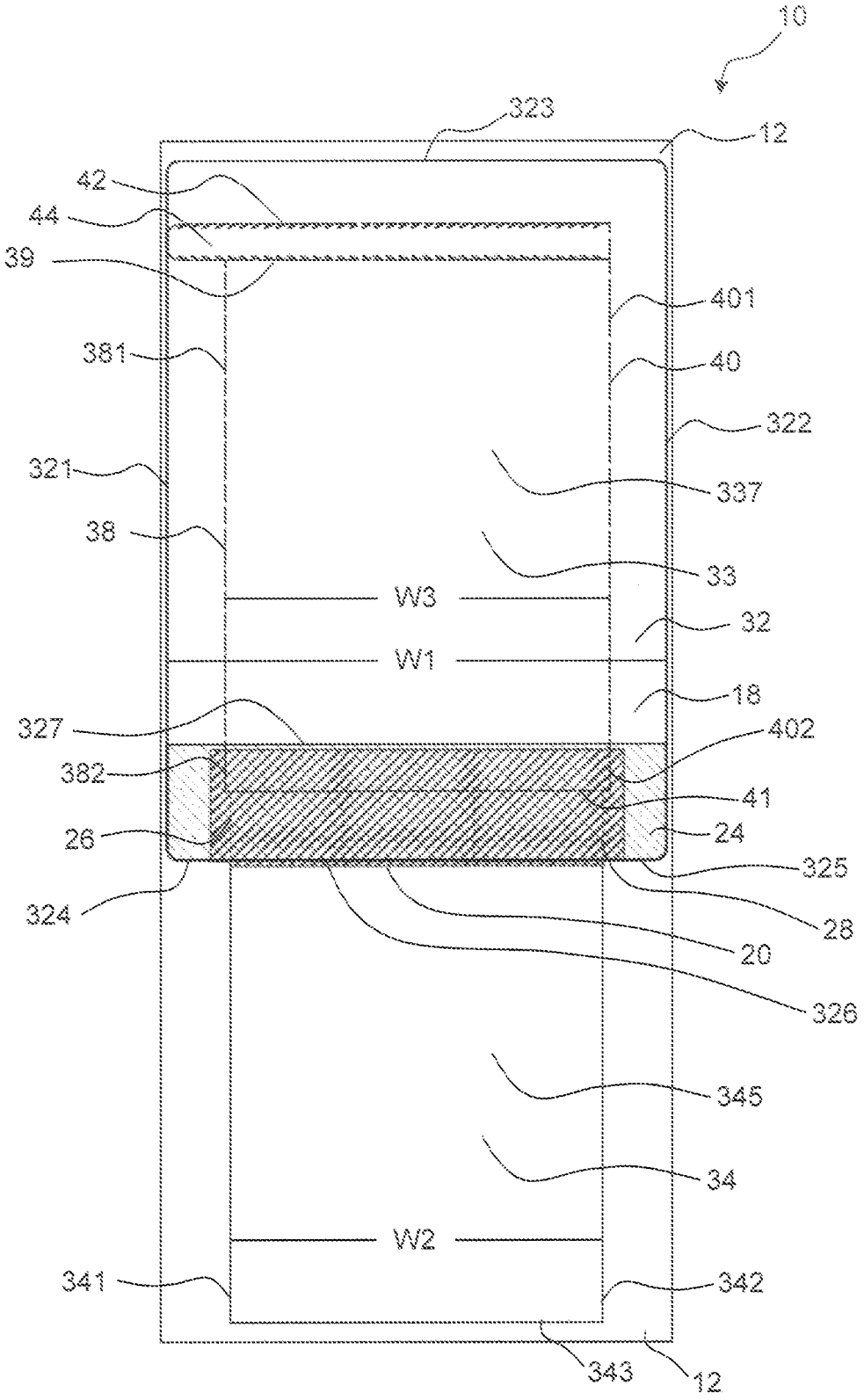
FIG. 4B shows a top view of a label form according to at least one embodiment of the present disclosure.

FIG. 4A shows a top view of a label form 10 according to at least one embodiment of the present disclosure. FIG. 4B shows a top view of label form 10 according to FIG. 4A, with substrate material 24 shown transparently for illustration purposes. As shown in FIGS. 4A-B, boundaries 321, 322, 323, 324, 325, 341, 342, and 343 have been die cut through label 18 and substrate material 24, but not into liner 12, and the portions of label 18 and substrate material 24 outside of the boundaries 321, 322, 323, 324, 325, 341, 342, and 343 have been removed, thereby revealing the surface of liner 12 and release coating 14 in those areas. As shown in FIGS. 4A-B, boundaries 324 and 325 align with lateral edge 326 of substrate material 24. As shown in FIG. 4B, boundaries 341 and 342 align with slits 26 and 28, respectively.

As shown in FIGS. 4A-B, a die cutting process has shaped label 18 into a first portion comprising covering section 32 and a second portion comprising foldable section 34. As shown in FIGS. 4A-B, covering section 32 is circumscribed by lateral edge 326 and boundaries 321, 322, 323, 324, and 325. Covering section 32 comprises first width W1 extending between boundaries 321 and 322. As shown in FIGS. 4A-B, foldable section 34 is bounded on three sides by boundaries 341, 342, and 343. Foldable section 34 comprises first surface 345, and a second width W2 extending between boundaries 341 and 342. Second width W2 is less than first width W1.

As shown in FIGS. 4A-B, covering section 32 further comprises lines of weakness 38, 39, 40, and 41. Lines of weakness 38, 39, 40, and 41 define the margins of a removable section 33. Line of weakness 41 also forms the fourth boundary of foldable section 34.

As shown in FIGS. 4A-B, removable section 33 comprises first surface 337. Removable section 33 further comprises third width W3 extending between lines of weakness 38 and 40. Third width W3 is less than first width W1 but greater than second width W2.

As shown in FIGS. 4A-B, line of weakness 38 comprises segment 381 and segment 382. As shown in FIGS. 4A-B, segment 381 begins at an intersection with line of weakness 39 and extends to lateral edge 327 of substrate material 24. Segment 382 begins at lateral edge 327 of substrate material 24 and extends to an intersection with line of weakness 41. Line of weakness 40 comprises segment 401 and segment 402. As shown in FIGS. 4A-B, segment 401 begins at an intersection with line of weakness 39 and extends to lateral edge 327 of substrate material 24. Segment 402 begins at lateral edge 327 of substrate material 24 and extends to an intersection with line of weakness 41. Lines of weakness 39 and 42 and segment 401 form margins of tear strip 44. Segments 381 and 401 and lines of weakness 39 and 42 are die cut through label 18, but not into liner 12. Segments 382 and 402 and line of weakness 41 are die cut through label 18 and substrate material 24, but not into liner 12.

Figure 4C:
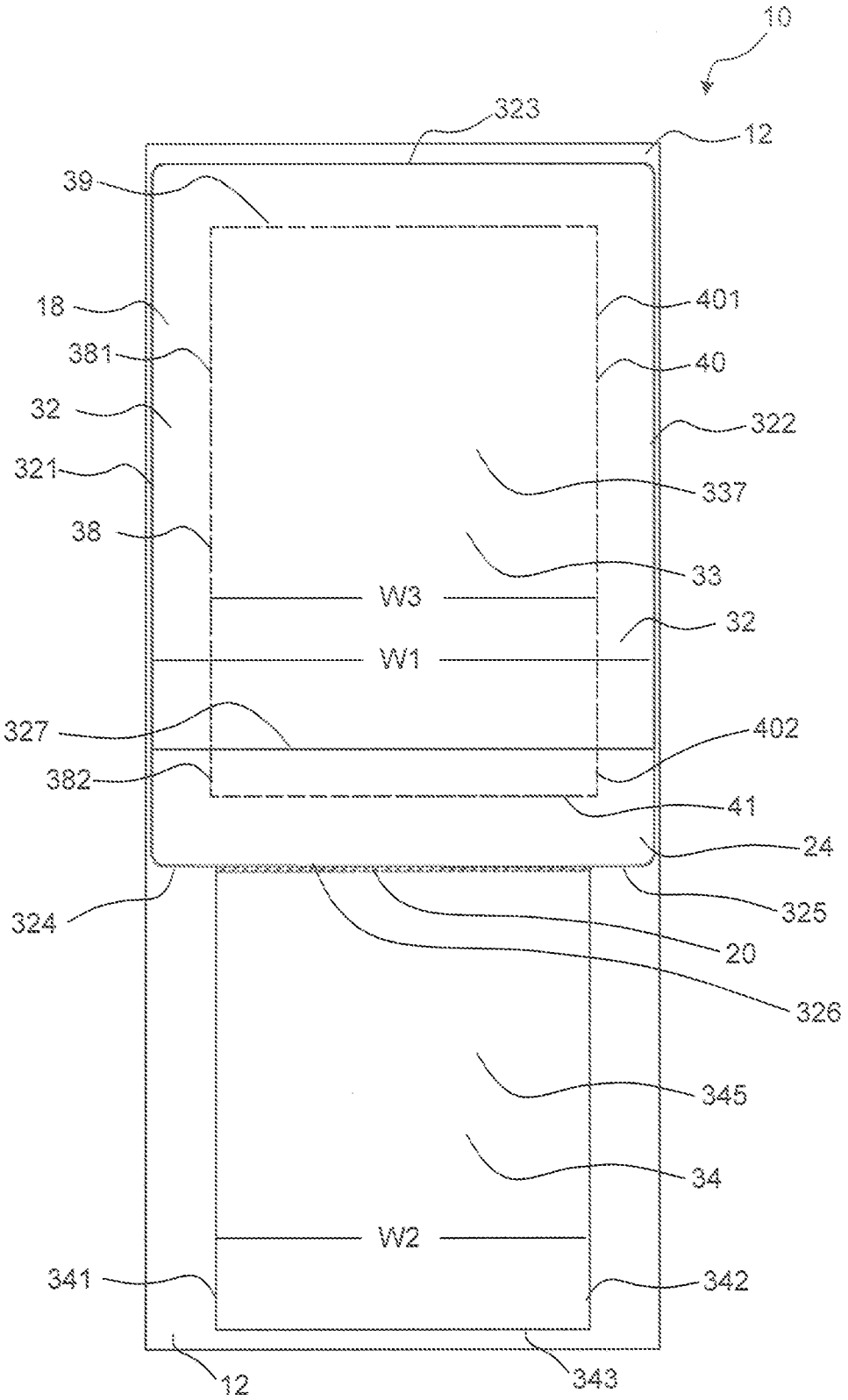
FIG. 4C shows a top view of a label form according to at least one embodiment of the present disclosure.

FIG. 4C shows a top view of a label form 10 according to at least one embodiment of the present disclosure. The embodiment of label form 10 shown in FIG. 4C is similar to the embodiment shown in FIGS. 4A-B, except that the embodiment of label form 10 shown in FIG. 4C does not include a tear strip.

Figure 5A:
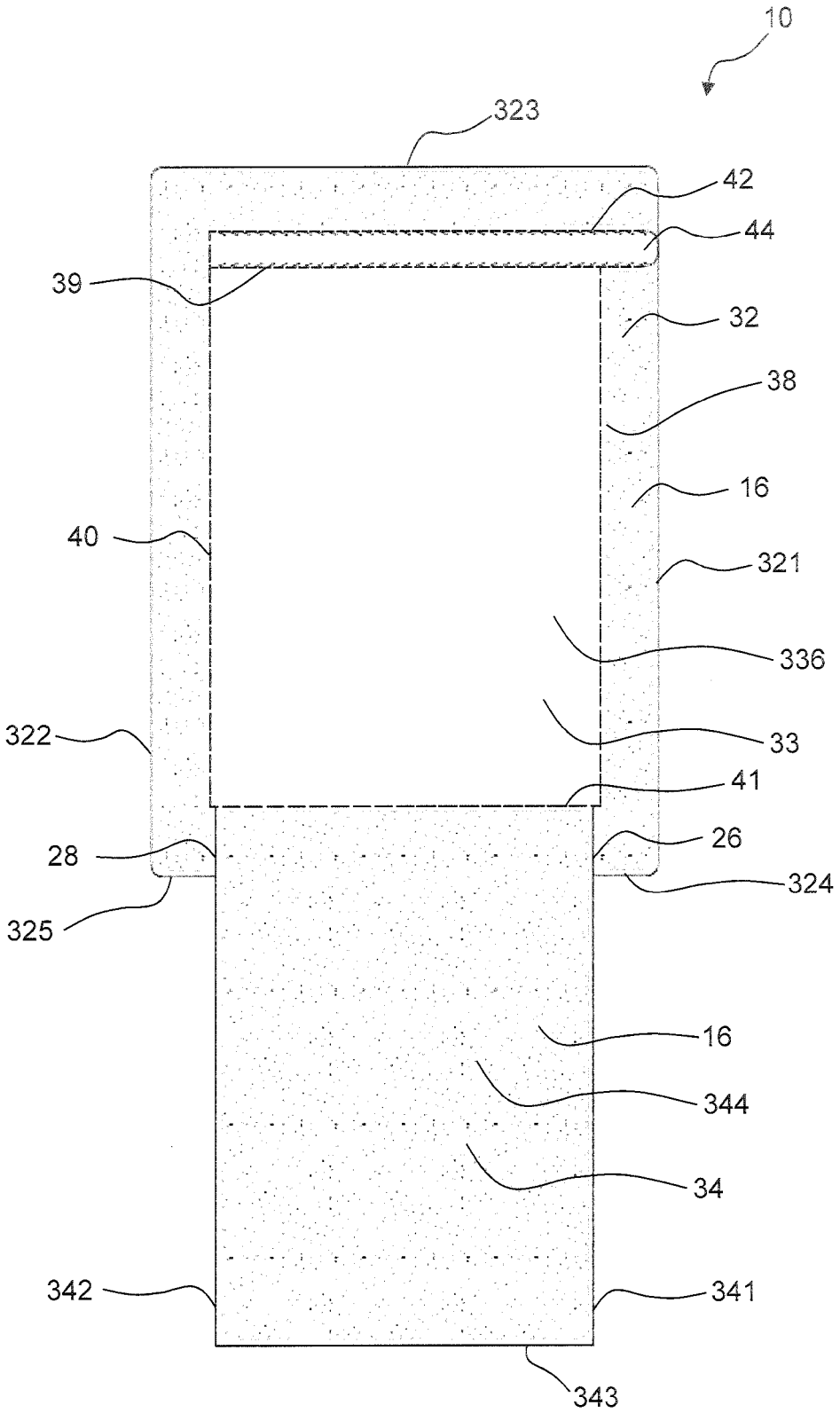
FIG. 5A shows a bottom view of a label form according to at least one embodiment of the present disclosure.

FIG. 5A shows a bottom view of label 18 comprising covering section 32, removable section 33 comprising second surface 336, and foldable section 34 comprising second surface 344, according to at least one embodiment of the present disclosure. Label 18 comprising covering section 32, removable section 33, and foldable section 34 is shown in FIG. 5A after removal from liner 12. As shown in FIG. 5A, adhesive 16 remains on the undersurface of label 18 after is it removed from liner 12. As shown in FIG. 5A, adhesive 16 was applied in a pattern such that second surface 336 of removable section 33 is void of adhesive 16. Shown in FIG. 5A are boundaries 321, 322, 323, 324, 325, 341, 342, and 343. As shown in FIG. 5A, boundaries 341 and 342 align with slits 26 and 28, respectively. Also shown in FIG. 5A are lines of weakness 38, 39, 40, 41, and 42, and the underside of tear strip 44. As shown in FIG. 5A, boundaries 341, 342, and 343 and line of weakness 41 define the margins of foldable section 34.

Figure 5B:
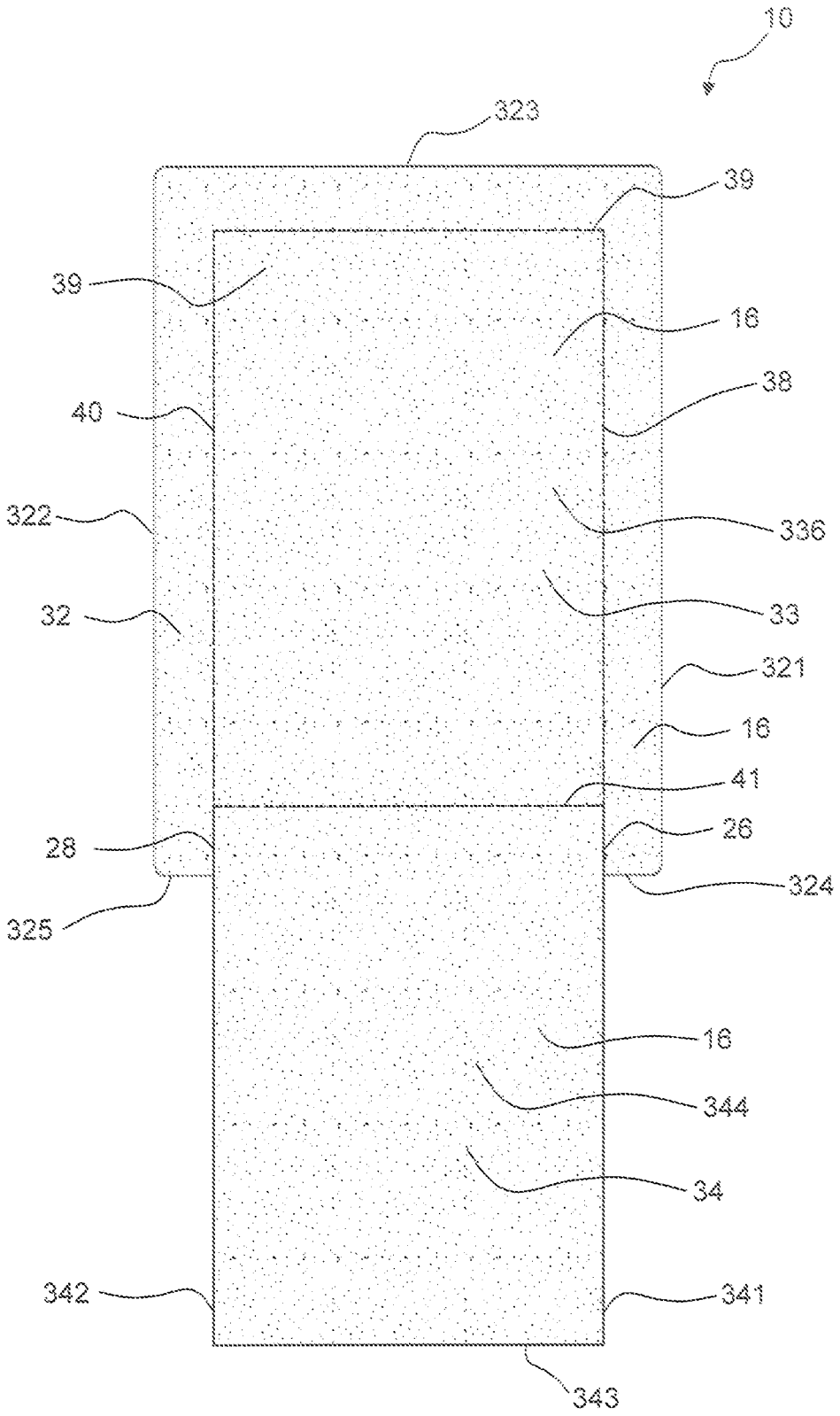
FIG. 5B shows a bottom view of a label form according to at least one embodiment of the present disclosure.

FIG. 5B shows a bottom view of label 18 comprising covering section 32, removable section 33 comprising second surface 336, and foldable section 34 comprising second surface 344, according to at least one embodiment of the present disclosure. Label 18 comprising covering section 32, removable section 33, and foldable section 34 is shown in FIG. 5B after removal from liner 12. As shown in FIG. 5B, adhesive 16 remains on the undersurface of label 18 after is it removed from liner 12. As shown in FIG. 5B, adhesive 16 was applied in a pattern such that second surface 336 of removable section 33 is covered by adhesive 16. Other patterns of adhesive 16 are possible and within the scope of the present disclosure. Shown in FIG. 5B are boundaries 321, 322, 323, 324, 325, 341, 342, and 343. As shown in FIG. 5B, boundaries 341 and 342 align with slits 26 and 28, respectively. Also shown in FIG. 5B are lines of weakness 38, 39, 40, and 41. The embodiment of label form 10 shown in FIG. 5B does not include a tear strip. As shown in FIG. 5B, boundaries 341, 342, and 343 and line of weakness 41 define the margins of foldable section 34 comprising second surface 344.

Figure 6:
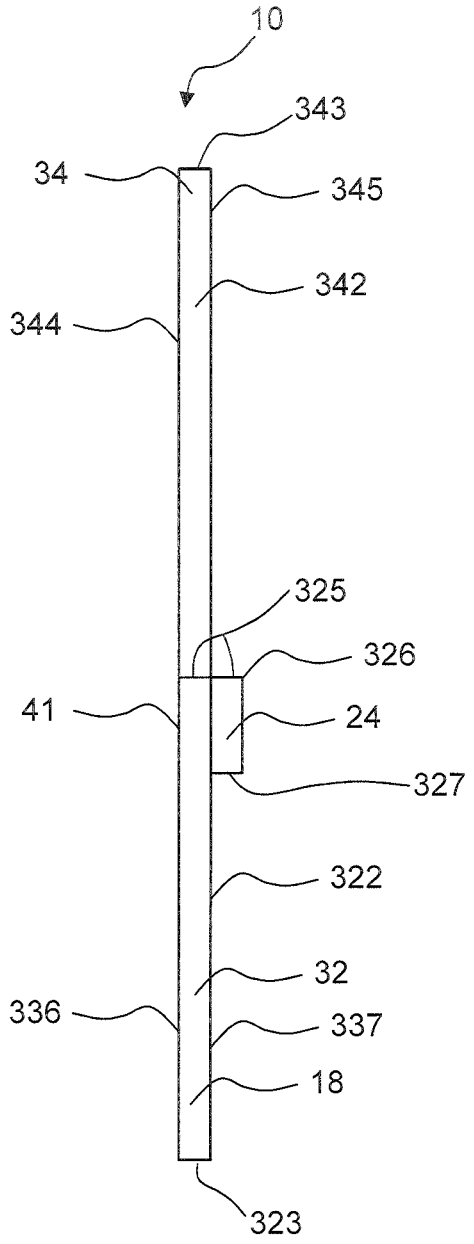
FIG. 6 shows a side view of a label form according to at least one embodiment of the present disclosure.

FIG. 6 shows a side view of label 18 according to at least one embodiment of the present disclosure. As shown in FIG. 6, label 18 has been removed from liner 12. Shown in FIG. 6 are label 18 comprising boundaries 322, 323, 325, and 343, covering section 32, foldable section 34, and substrate material 24 comprising boundary 325 and lateral edges 326 and 327. Also shown in FIG. 6 are the locations of surfaces 336 and 337 of removable section 33 and surfaces 344 and 345 of foldable section 34, as well as the location of line of weakness 41. For purposes of clarity, adhesive 16, release patch 20, and adhesive 22 are not shown in FIG. 6. In this embodiment of label 18 shown in FIG. 6, adhesive 16 covers all or a portion of surface 344 and all or a portion of the underside of covering section 32, as shown, for example, in FIGS. 3C, 5A, and/or 5B. In this embodiment of label 18 shown in FIG. 6, release patch 20 and adhesive 22 exist as shown, for example, in FIGS. 3B, 3C, and 4B.

Figure 7:
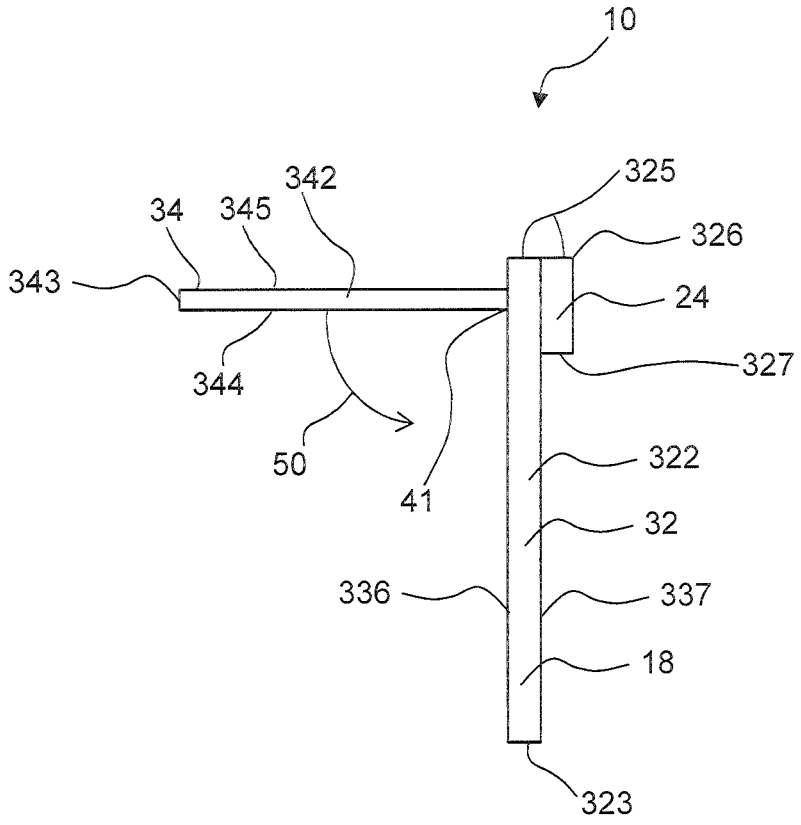
FIG. 7 shows a side view of a label form according to at least one embodiment of the present disclosure.

FIG. 7 shows a side view of label 18 according to at least one embodiment of the present disclosure. As shown in FIG. 7, label 18 has been removed from liner 12. Shown in FIG. 7 are label 18 comprising boundaries 322, 323, 325, and 343, covering section 32, foldable section 34, and substrate material 24 comprising boundary 325 and lateral edges 326 and 327. Also shown in FIG. 7 are the locations of surfaces 336 and 337 of removable section 33 and surfaces 344 and 345 of foldable section 34, as well as the location of line of weakness 41. For purposes of clarity, adhesive 16, release patch 20, and adhesive 22 are not shown in FIG. 7. In this embodiment of label 18 shown in FIG. 7, adhesive 16 covers all or a portion of surface 344 and all or a portion of the underside of covering section 32, as shown, for example, in FIGS. 3C, 5A, and/or 5B. In this embodiment of label 18 shown in FIG. 7, release patch 20 and adhesive 22 exist as shown, for example, in FIGS. 3B, 3C, and 4B. As shown in FIG. 7, foldable section 34 is separated from covering section 32 at slits 26 and 28 (not shown) and displaced in the direction of arrow 50. Foldable section 34 remains attached to covering section 32 at line of weakness 41, with line of weakness 41 forming a hinge around which foldable section 34 pivots. Surface 344 of foldable section 34 is directed toward surface 336 of removable section 33, as shown by arrow 50.

Figure 8:
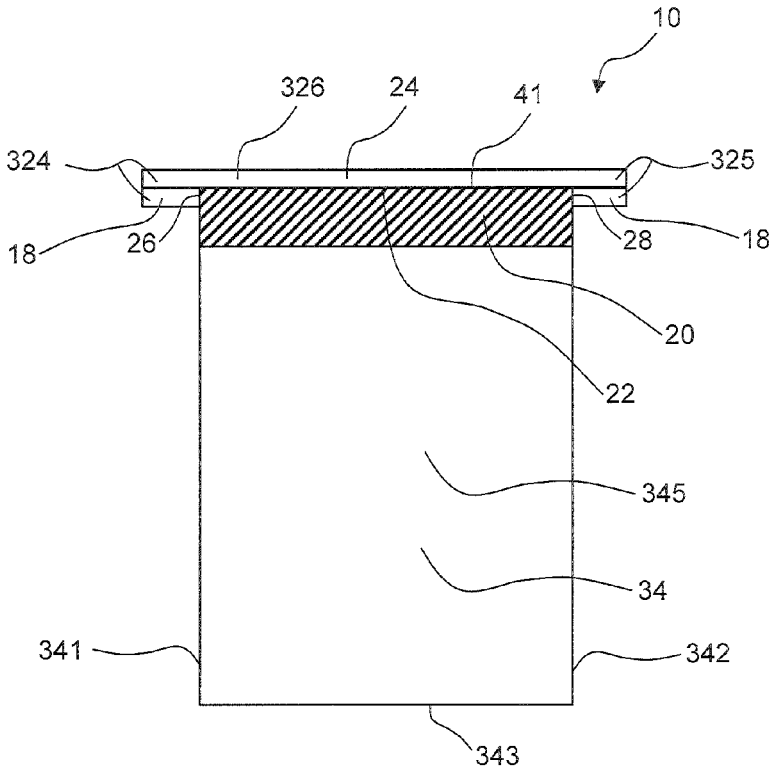
FIG. 8 shows an end view of a label form according to at least one embodiment of the present disclosure.

FIG. 8 shows an end view of label 18 of FIG. 7. Shown in FIG. 8 are label 18 comprising boundaries 324, 325, 341, 342, and 343, foldable section 34, and substrate material 24 comprising boundaries 324 and 325 and lateral edge 326. Also shown in FIG. 8 is surface 345 of foldable section 34, which includes a portion of release patch 20 attached thereto. As shown in FIG. 8, foldable section 34 is separated slits 26 and 28 and displaced. Foldable section 34 remains attached at line of weakness 41, with line of weakness 41 forming a hinge around which foldable section 34 pivots. When foldable section 34 is displaced as shown in FIG. 8, a portion of release patch 20 also is displaced as shown in FIG. 8. Displacing this portion of release patch 20 as shown in FIG. 8 reveals adhesive 22 on a corresponding portion of the underside of substrate material 24.

Figure 9A:
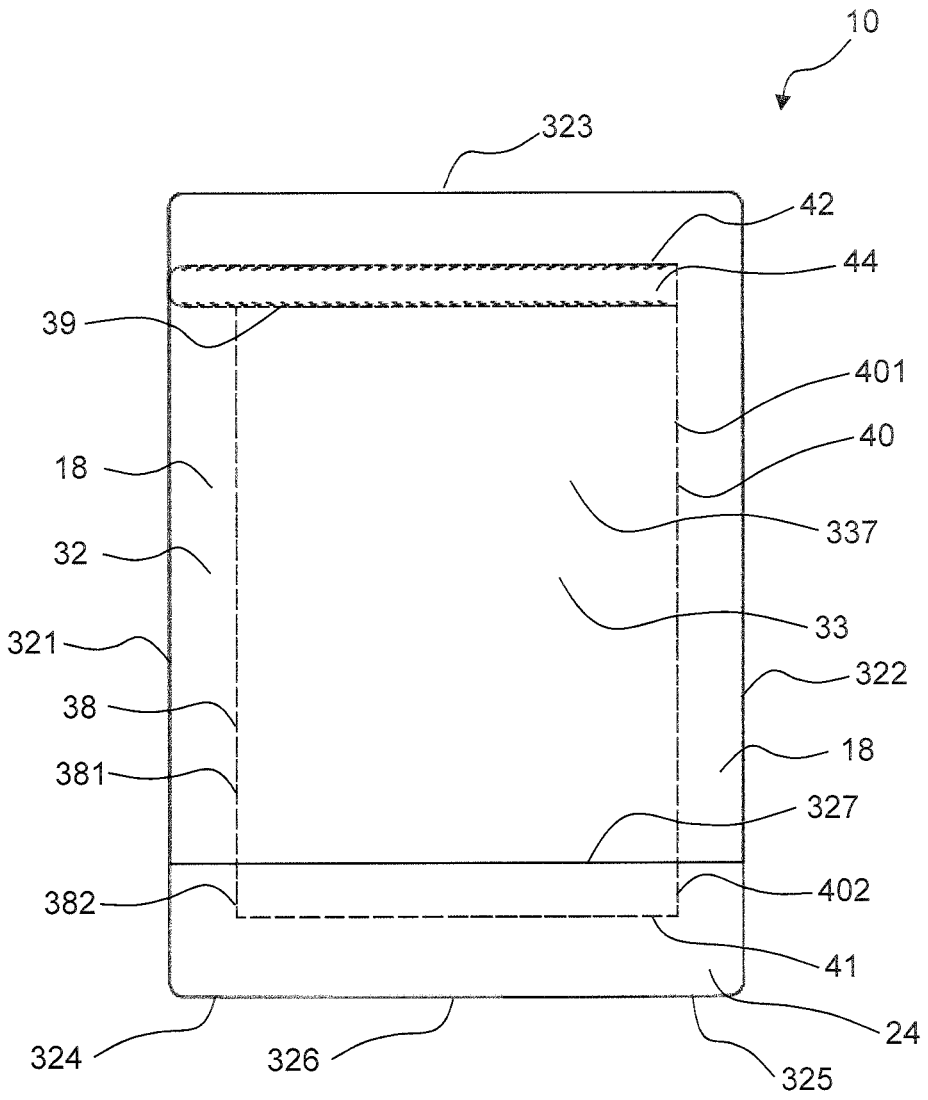
FIG. 9A shows a top view of a label form according to at least one embodiment of the present disclosure.
Figure 9B:
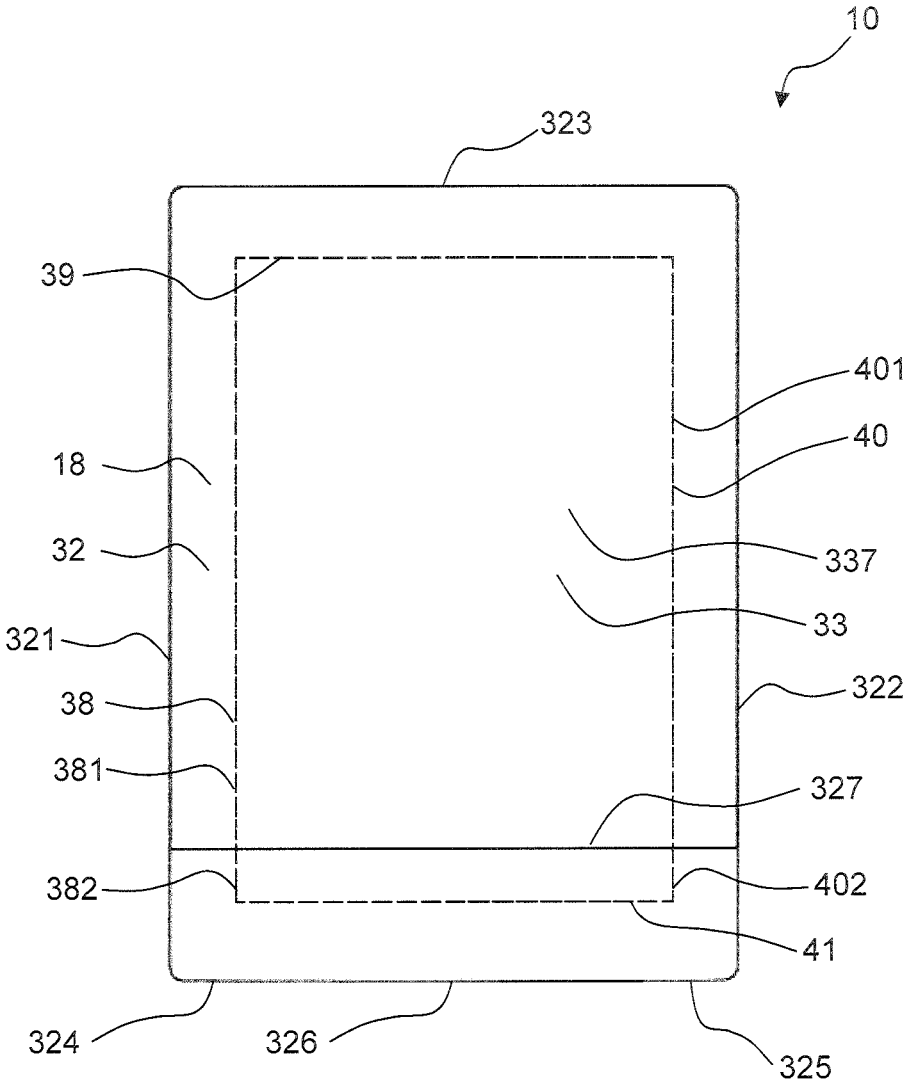
FIG. 9B shows a top view of a label form according to at least one embodiment of the present disclosure.

FIG. 9A shows a top view of an embodiment of covering section 32 with foldable section 34 completely concealed under covering section 32. FIG. 9B shows a top view of an embodiment of covering section 32 with foldable section 34 completely concealed under covering section 32. The embodiments of FIG. 9A and FIG. 9B differ in that the embodiment of FIG. 9A includes a tear strip 44, while the embodiment of FIG. 9B does not. With reference to FIG. 7, as shown in FIGS. 9A-9B, foldable section 34 has been displaced in the direction of arrow 50 such that surface 344 is brought into contact with surface 336. As discussed elsewhere herein, in at least one embodiment surface 344 comprises adhesive 16. When surface 344 is brought into contact with surface 336, adhesive 16 on surface 344 substantially permanently adheres surface 344 to surface 336. As discussed elsewhere herein, in at least one embodiment surface 344 comprises adhesive 16 and surface 336 comprises adhesive 16. When surface 344 is brought into contact with surface 336, adhesive 16 on surface 344 and adhesive 16 on surface 336 substantially permanently adheres surface 344 to surface 336.

Figure 10:
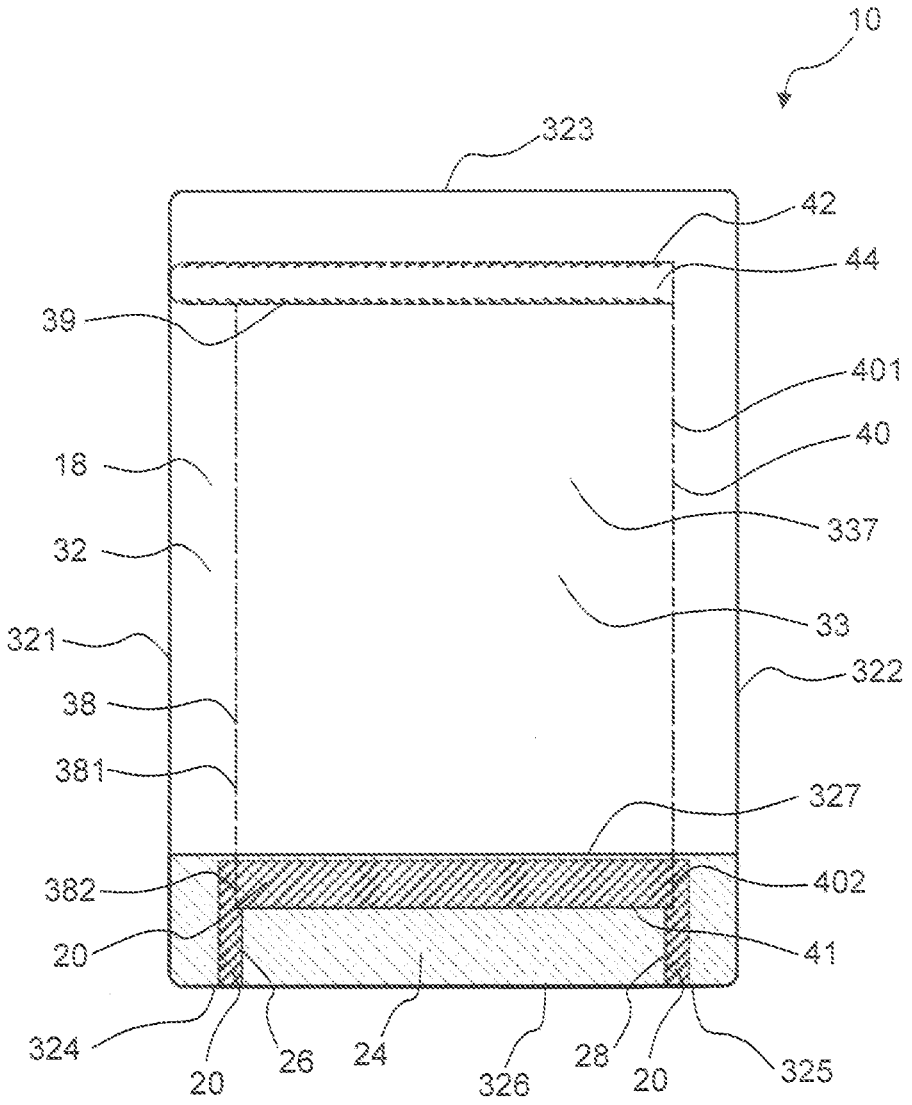
FIG. 10 shows a top view of a label form according to at least one embodiment of the present disclosure.

FIG. 10 shows a top view of the embodiment of covering section 32 of FIG. 9A, with substrate material 24 shown transparently for illustration purposes. As shown in FIG. 10, foldable section 34 is completely concealed under covering section 32. With reference to FIG. 7, as shown in FIG. 10, foldable section 34 has been displaced in the direction of arrow 50 such that surface 344 is brought into contact with surface 336, with line of weakness 41 serving as a hinge around which foldable section 34 is displaced. With reference to FIG. 8, when foldable section 34 is displaced a portion of release patch 20 also is displaced. As shown in FIG. 10, only the portion of release patch 20 outside of slits 26 and 28 and line of weakness 41 remains in place. As shown in FIG. 10, the portion of release patch 20 that previously was underneath substrate material 24 within the boundaries of slits 26 and 28 and line of weakness 41 is displaced. With reference to FIG. 8, displacing this portion of release patch 20 reveals adhesive 22 (not shown in FIG. 10) on the corresponding portion of the underside of substrate material 24.

Figure 11:
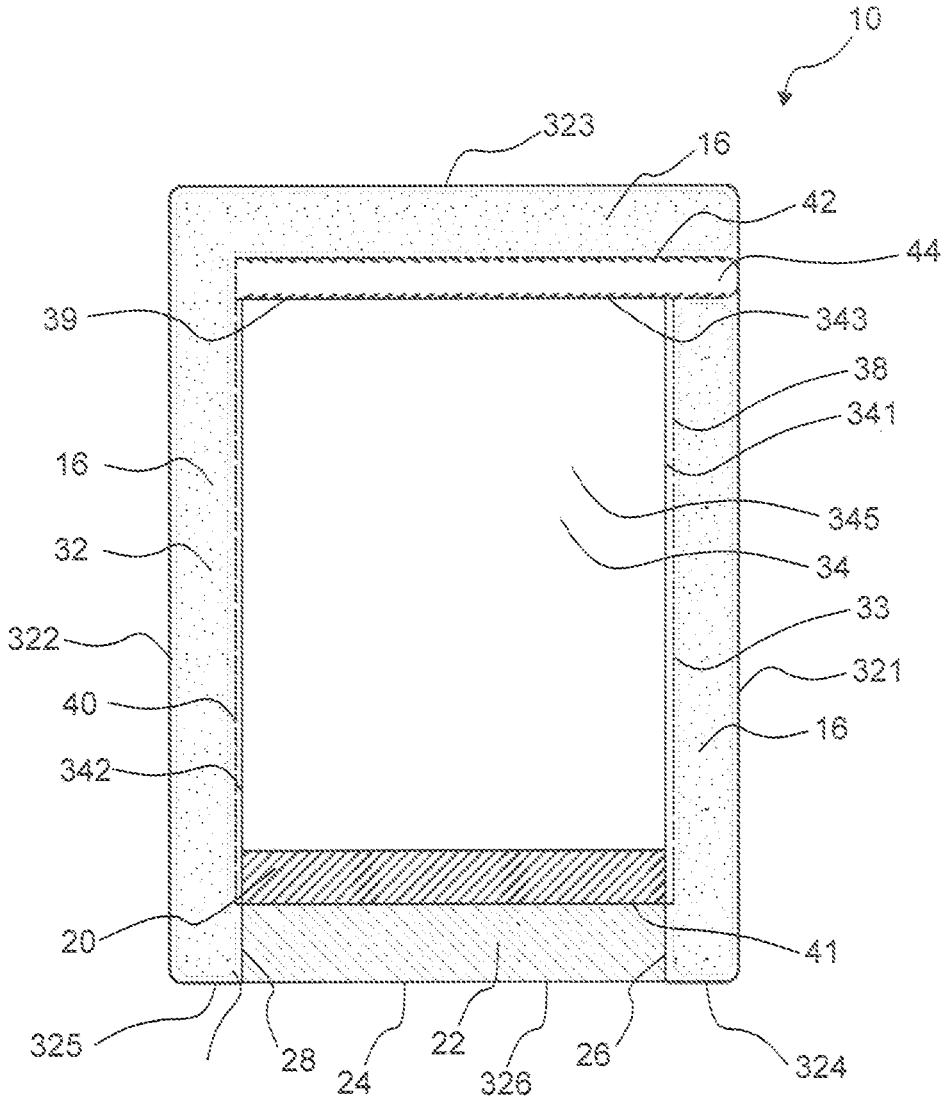
FIG. 11 shows a bottom view of a label form according to at least one embodiment of the present disclosure.

FIG. 11 shows a bottom view of the embodiment of covering section 32 of FIGS. 9A and 10. With reference to FIG. 7, as shown in FIG. 11, foldable section 34 has been displaced in the direction of arrow 50 such that surface 344 (not shown in FIG. 11) is brought into contact with surface 336 (not shown in FIG. 11). In the bottom view of covering section 32 shown in FIG. 11, surface 345 of foldable section 34 is visible. Foldable section 34 is bounded by boundaries 341, 342, and 343, and line of weakness 41. Surface 345 comprises a portion of release patch 20. Also shown in FIG. 11 are lines of weakness 38, 39, 40, and 42. Lines of weakness 38, 39, 40, and 41 comprise the margins of removable section 33. In the embodiment shown in FIG. 11, lines of weakness 39 and 42 define tear strip. Other embodiments have no tear strip. As discussed elsewhere herein, when foldable section 34 is displaced the portion of release patch 20 shown in FIG. 11 also is displaced. Displacing this portion of release patch 20 reveals adhesive 22 as shown in FIG. 11 on the portion of the underside of substrate material 24 bounded by slits 26 and 28, line of weakness 41, and lateral edge 326. Adhesive 16 is shown in FIG. 11 on other surfaces of covering section 32.

Figure 12:
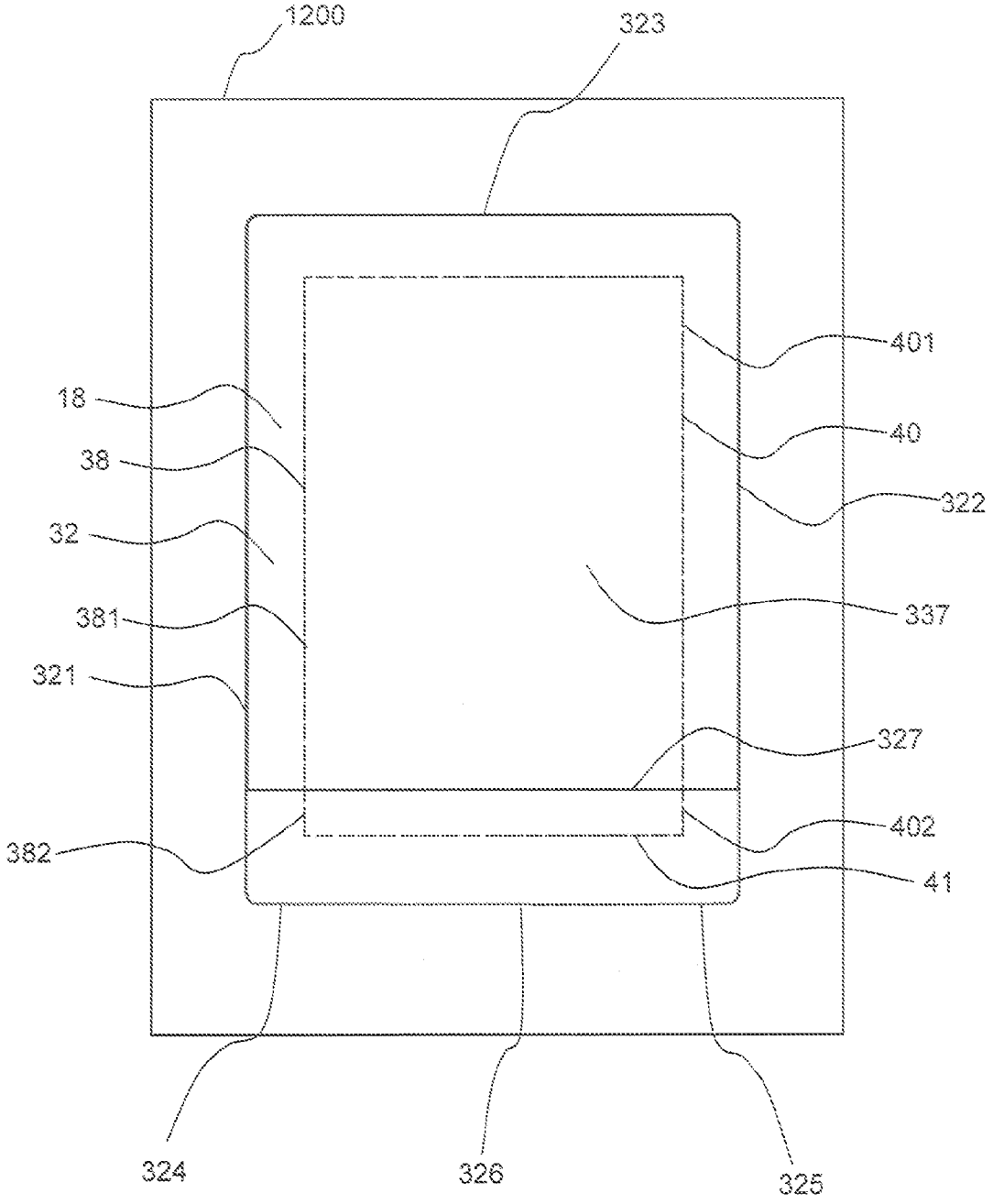
FIG. 12 shows a label form according to at least one embodiment of the present disclosure attached to a container.

FIG. 12 shows a label according to at least one embodiment of the present disclosure attached to a container. Shown in FIG. 12 are container 1200 with label 18 attached thereto. FIG. 12 shows a top view of an embodiment of covering section 32 with foldable section 34 completely concealed under covering section 32. With reference to FIG. 7, as shown in FIG. 12, foldable section 34 has been displaced in the direction of arrow 50 such that surface 344 is brought into contact with surface 336. As discussed elsewhere herein, in at least one embodiment surface 344 comprises adhesive 16. When surface 344 is brought into contact with surface 336, adhesive 16 on surface 344 substantially permanently adheres surface 344 to surface 336. As discussed elsewhere herein, in at least one embodiment surface 344 comprises adhesive 16 and surface 336 comprises adhesive 16. When surface 344 is brought into contact with surface 336, adhesive 16 on surface 344 and adhesive 16 on surface 336 substantially permanently adheres surface 344 to surface 336.

Figure 13:
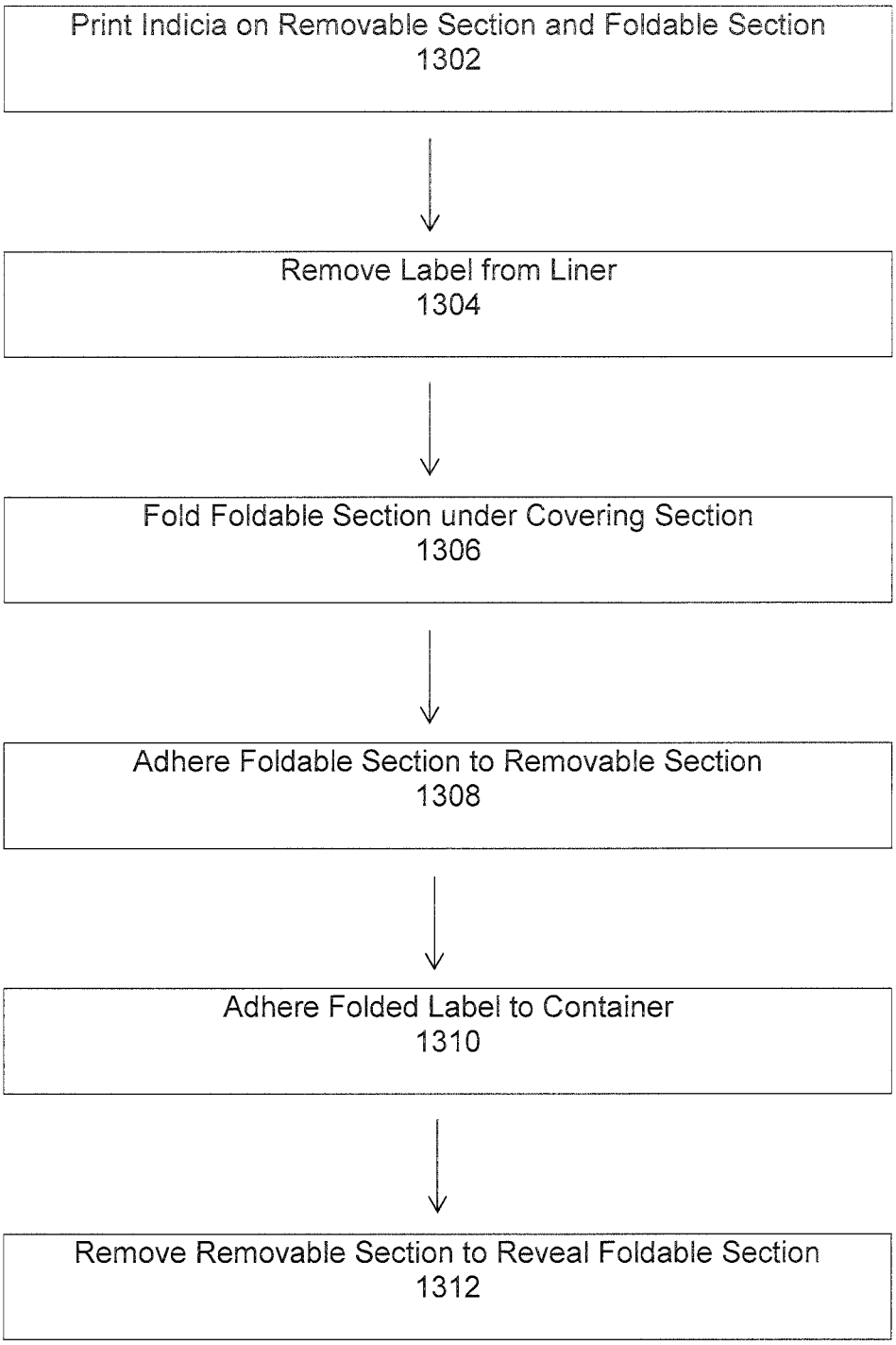
FIG. 13 shows a flowchart illustrating the use of a label form according to at least one embodiment of the present disclosure.

FIG. 13 shows a flowchart illustrating the use of label form 10 according to at least one embodiment of the present disclosure. As shown in step 1302 of FIG. 13, indicia is printed on removable section 33 and foldable section 34. Such indicia may be information such as, for example, shipping and/or return addresses, directions on how to use label form 10, packing list information, business information such as phone numbers and the name of the business, or the like. Such indicia may include, for example, information explaining the return or exchange policy for a package affixed with a label with the indicia, bar codes, identifying numbers, or maxicodes. As shown in step 1304 of FIG. 13, the label comprising covering section 32, removable section 33, and foldable section 34 is removed from liner 12. As shown in step 1306 of FIG. 13, foldable section 34 is folded under covering section 32. As shown in step 1308 of FIG. 13, foldable section 34 is adhered to removable section 33. As shown in step 1310 of FIG. 13, the folded label is adhered to a container. With reference to FIG. 11, the regions covered by exposed adhesive 16 and adhesive 22 are used to adhere the label to a container. In at least one embodiment, steps 1302-1310 are performed automatically by machinery adapted to perform such steps.

As shown in step 1312 of FIG. 13, removable section 33 is removed to reveal foldable section 34. In an embodiment of label form 10 of the present disclosure that comprises a tear strip such as tear strip 44, removable section 33 is removed by separating tear strip 44 along lines of weakness 39 and 42, and then separating removable section 33 from the rest of covering section 32 along lines of weakness 38, 40, and 41. Foldable section 34 is adhered to removable section 33. Accordingly, foldable section 34 is separated from line of weakness 41 as removable section 33 is separated from line of weakness 41.

In an embodiment of label form 10 of the present disclosure that does not comprise a tear strip, removable section 33 is removed by separating removable section 33 from the rest of covering section 32 along lines of weakness 38, 39, 40, and 41. Foldable section 34 is adhered to removable section 33. Accordingly, foldable section 34 is separated from line of weakness 41 as removable section 33 is separated from line of weakness 41.

While this disclosure has been described as having preferred designs, the apparatus and methods according to the present disclosure can be further modified within the scope and spirit of this disclosure. This application is therefore intended to cover any variations, uses, or adaptations of the disclosure using its general principles. For example, any method disclosed herein and in the appended claims represent one possible sequence of performing the steps thereof. A practitioner may determine in a particular implementation that a plurality of steps of one or more of the disclosed methods may be combinable, or that a different sequence of steps may be employed to accomplish the same results. Each such implementation falls within the scope of the present disclosure as disclosed herein and in the appended claims. Furthermore, this application is intended to cover such departures from the present disclosure as come within known or customary practice in the art to which this disclosure pertains.

We claim:

1. A label form comprising;

a sheet material, said sheet material comprising a first surface and a second surface opposite said first surface, said sheet material comprising a covering section and a concealable section connected to said covering section and folded under said covering section such that said concealed section is in contact with said second surface of said covering section, said second surface of said covering section comprising adhesive on an area partially surrounding said concealed section; and a substrate material, said substrate material comprising a top surface and an undersurface opposite said top surface, said substrate material mounted to said first surface of said sheet material, said undersurface of said substrate material comprising adhesive on at least a portion thereof, said undersurface comprising a first part and a second part, said first part being adhered by said adhesive to said first surface of said sheet material and said second part comprising exposed said adhesive.

2. The label form of claim 1, further comprising:

at least one line of weakness through said sheet material and said substrate material, said at least one line of weakness defining boundaries of a removable area of said covering section.

3. The label form of claim 2, wherein said removable area of said covering section is in alignment with said folded-under concealed section.

4. A label form comprising:

a sheet material, said sheet material comprising a first surface and a second surface opposite said first surface, said sheet material comprising a covering section and a concealable section connected to said covering section, said covering section comprising a bottom margin, said sheet material comprising a first line of weakness through said sheet material, said first line of weakness defining a top edge of said concealable section;

a substrate material, said substrate material comprising a top surface and an undersurface opposite said top surface, said substrate material comprising at least one substrate material boundary, said substrate material mounted to said first surface of said sheet material with said undersurface of said substrate material adhered to said first surface of said sheet material, said substrate material covering said first line of weakness.

5. The label form of claim 4, wherein said top edge of said concealable section is inboard of said bottom margin of said covering section.

6. The label form of claim 4, wherein said concealable section is foldable at said first line of weakness to an orientation where said bottom surface of said concealable section is in contact with said bottom surface of said covering section.

7. The label form of claim 4, wherein at least a portion of said bottom surface of said covering section comprises adhesive.

8. The label form of claim 4, further comprising:

a release patch on said first surface, said release patch being underneath at least a portion of said substrate material, said portion of said substrate material removably adhered to said release patch.

9. The label form of claim 8, wherein a first part of said release patch is on said covering section.

10. The label form of claim 8, wherein second part of said release patch is on said concealable section.

11. The label form of claim 10, wherein said concealable section is foldable at said first line of weakness, and wherein when said concealable section is folded at said first line of weakness said second part of said release patch separates from said substrate material.

12. The label form of claim 4, herein said concealable section is foldable at said first line of weakness, and wherein when said concealable section is folded at said first line of weakness a portion of said undersurface of said substrate material is revealed.

13. The label form of claim 4, further comprising:

a second line of weakness through said substrate material, said second line of weakness in registration with said first line of weakness.

14. The label form of claim 13, wherein said second line of weakness is at least as long as said first line of weakness.

15. The label form of claim 13, further comprising:

at least one other line of weakness through said sheet material and said substrate material, said at least one other line of weakness connected to endpoints of said first line of weakness, said first line of weakness and said at least one other line of weakness defining boundaries of a removable area of said covering section.

16. The label form of claim 15, wherein said second line of weakness, said at least one other line of weakness, and said at least one substrate material boundary define a removable sector of said substrate material, said removable sector of said substrate material being adhered to said removable area of said sheet material.

17. The label form of claim 15, wherein said concealable section is foldable at said first line of weakness to an orientation where said bottom surface of said concealable section is in contact with said bottom surface of said covering section, and wherein when said concealable section is folded into such an orientation said concealable section fits within said boundaries of said removable area of said covering section.

18. A container comprising:

a face;

a label, said label comprising:

a sheet material, said sheet material comprising a first surface and a second surface opposite said first surface, said sheet material comprising a covering section and a concealable section connected to said covering section and folded under said covering section, at least a portion of said second surface being adhered to said face; and a substrate material, said substrate material comprising a top surface and an undersurface opposite said top surface, said substrate material mounted to said first surface of said sheet material, said undersurface of said substrate material comprising adhesive on at least a portion thereof, said undersurface comprising a first part and a second part, said first part being adhered to said first surface of said sheet material and said second part being adhered to said face.

19. The container of claim 18, wherein said label further comprises:

at least one line of weakness through said sheet material and said substrate material, said at least one line of weakness defining boundaries of a removable area of said covering section.

20. The container of claim 19, wherein said removable area of said covering section is in alignment with said folded-under concealed section.

* * * * *